US012790928B1

(12) United States Patent
Modeland et al.

(10) Patent No.: US 12,790,928 B1
(45) Date of Patent: Nov. 10, 2026

(54) MULTI-WELL REFRACTURING STIMULATION BY SIMULTANEOUSLY BULLHEAD FRACTURING WELLS AND/OR EMPLOYING TEMPORARY SEALANT

(71) Applicant: Halliburton Energy Services, Inc., Houston, TX (US)

(72) Inventors: Neil Joseph Modeland, Houston, TX (US); Andrew Traweek, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/305,087

(22) Filed: Aug. 20, 2025

(51) Int. Cl.
*E21B 43/26* (2006.01)
*E21B 33/138* (2006.01)

(52) U.S. Cl.
CPC ..... *E21B 43/261* (2013.01); *E21B 33/138* (2013.01)

(58) Field of Classification Search
CPC ..... E21B 43/281; E21B 33/138
USPC ..... 166/281
See application file for complete search history.

(56) References Cited

U.S. PATENT DOCUMENTS 7,841,394 B2 11/2010 McNeel et al.
8,157,011 B2 * 4/2012 Taylor ..... E21B 28/00 166/250.1
2006/0118305 A1 6/2006 East, Jr. et al.
2013/0062057 A1 * 3/2013 Smith, Jr. ..... E21B 43/267 166/254.2
2016/0376882 A1 12/2016 Mendell et al.
2018/0023375 A1 1/2018 Potapenko et al.
2019/0203574 A1 * 7/2019 Yi ..... E21B 43/11
2019/0309618 A1 10/2019 Inyang et al.
2020/0270977 A1 8/2020 Kraynek
(Continued)

OTHER PUBLICATIONS

T. Bach et al., "Polymer Sealant for Unwanted Gas in Openhole Gravel-Pack Completion," SPE 68975, European Formation Damage Conference held in The Hague, The Netherlands, May 21-22, 2001. 17 Pages.

(Continued)

*Primary Examiner* — William D Hutton, Jr.
*Assistant Examiner* — Ashish K Varma
(74) *Attorney, Agent, or Firm* — Conley Rose, P.C.; Rodney B. Carroll

(57) ABSTRACT

A method including (a) introducing a fracturing fluid into each of a plurality of previously-fractured wellbores, wherein the fracturing fluid induces fractures in at least one zone of at least one of the plurality of wellbores, and wherein the fracturing fluid is introduced into each of the plurality of previously-fractured wellbores concurrently/simultaneously for at least a portion of a duration of the introducing; (b) introducing a diverter fluid into each of the plurality of previously-fractured wellbores, wherein the diverter fluid flows into the induced fractures of the at least one zone, reducing flow thereto, and wherein the diverter fluid is introduced into each of the plurality of previously-fractured wellbores concurrently/simultaneously for at least a portion of a duration of the introducing; and (c) repeating (a) and (b). The plurality of wellbores are positioned so induced pressure/stress produced by the introduction of the fracturing fluid promote uniform refracturing along the length.

20 Claims, 10 Drawing Sheets

(56) References Cited

U.S. PATENT DOCUMENTS

2022/0325621 A1* 10/2022 Moos ..... E21B 43/26
2023/0250712 A1* 8/2023 Song ..... E21B 47/107
175/4.57

OTHER PUBLICATIONS

Joseph Mechler et al., "Restimulation Design Considerations and Case Studies of Haynesville Shale," SPE-174819-MS, SPE Annual Technical Conference and Exhibition held in Houston, Texas, USA, Sep. 28-30, 2015. 21 pages.
David Russell et al., "Simultaneous Hydraulic Fracturing Improves Completion Efficiency and Lowers Costs Per Foot," SPE-204138-MS, presentation at the SPE Hydraulic Fracturing Technology Conference and Exhibition to be held virtually on May 4-6, 2021. The official proceedings were published online on Apr. 27, 2021. 12 pages.
Awais Navaiz et al., "Delineating and Quantifying the Hydraulic Fracturing Energy System," SPE-213076-MS, presentation at the SPE Oklahoma City Oil and Gas Symposium, held in Oklahoma City, Oklahoma, USA, Apr. 17-19, 2023. 10 pages.
R. Traweek et al., "Monitoring the Effectiveness of a Bullhead Refrac Using Temporarily Deployed Fiber Optic Cable," SPE-223536-MS, presentation at the SPE Hydraulic Fracturing Technology Conference and Exhibition, The Woodlands, Texas, USA, Feb. 4-6, 2025. 12 pages.
Peter Kaufman et al., "Optimizing Completions in Tank Style Development," URTeC: 608, presentation at the Unconventional Resources Technology Conference held in Denver, Colorado, USA, Jul. 22-24, 2019. 15 pages.
Amos S. Kim et al., "Simul-frac Journey in the Permian Basin," URTeC: 5340, presentation at the Unconventional Resources Technology Conference held in Houston, Texas, USA,Jul. 26-28, 2021. 7 pages.
Andrew Whitsett et al., "Maximizing Efficiency in Haynesville Restimulations: A Case Study Improving Lateral Coverage to Maximize Incremental Gas Recovery," URTeC: 2443071, presentation at the Unconventional Resources Technology Conference held in San Antonio, Texas, USA, Aug. 1-3, 2016. 18 pages.
Kevin Eichinger et al., "Hybrid Expandable Liner System: A Performance-Enhancing, Cost-Effective Alternative to Bullhead Refracturing," URTeC: 3855094, presentation at the Unconventional Resources Technology Conference held in Denver, Colorado, USA, Jun. 13-15, 2023. 10 pages.
Foreign Communication from Related Application—International Search Report and Written Opinion of the International Searching Authority, International Application No. PCT/US2026/029887 dated Sep. 2, 2026, 12 pages.

* cited by examiner

MULTI-WELL REFRACTURING STIMULATION BY SIMULTANEOUSLY BULLHEAD FRACTURING WELLS AND/OR EMPLOYING TEMPORARY SEALANT

BACKGROUND

This disclosure relates generally to hydraulic fracturing; more particularly, this disclosure relates to refracturing of previously-fractured wellbores via simultaneous bullhead refracturing and/or the use of a temporary sealant barrier to prevent heel-side bias during the refracturing.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
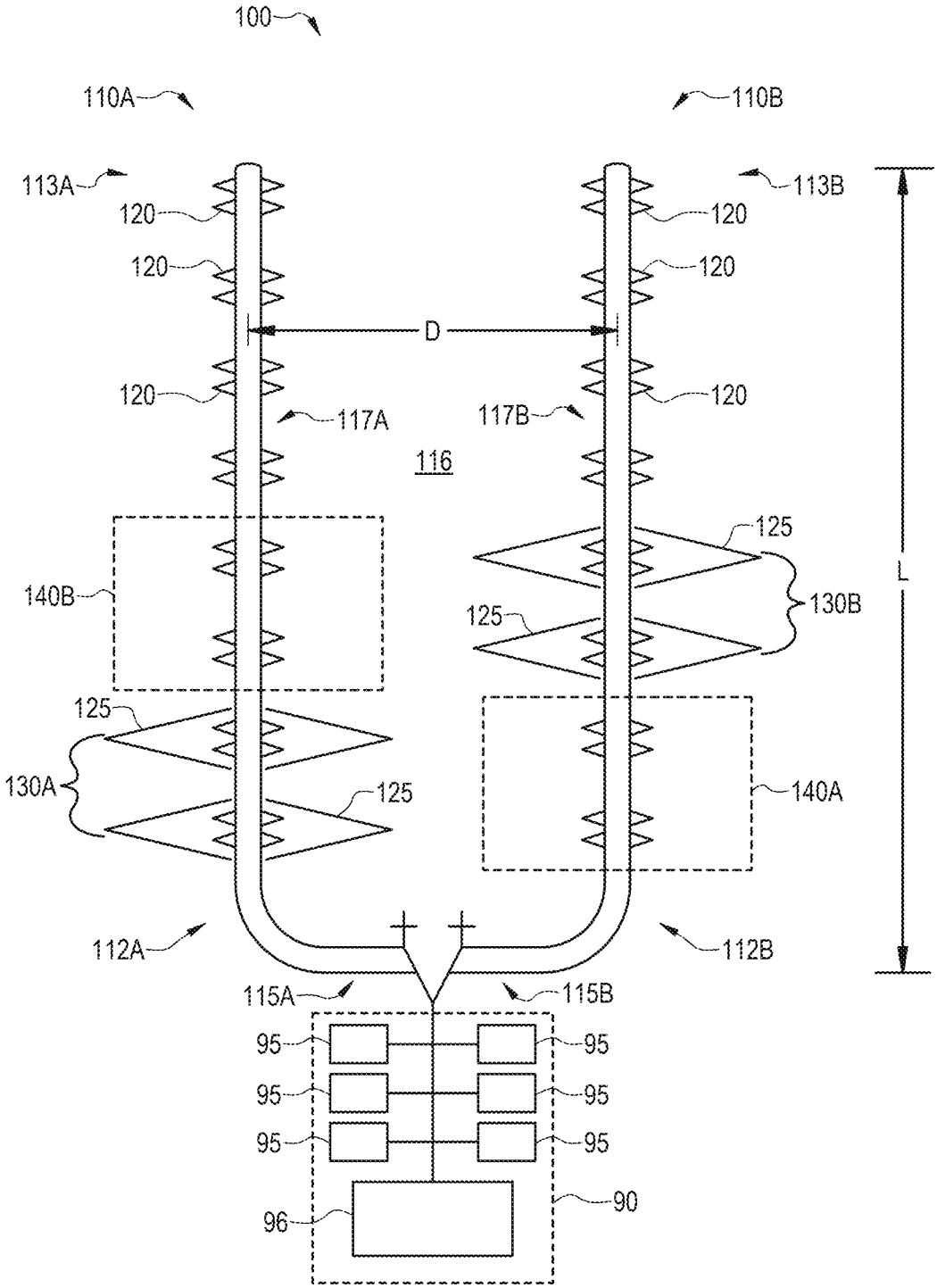
FIG. 1 is a schematic illustration of a two-well example of simultaneous bullhead refracturing, according to embodiments of this disclosure.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

It is to be understood that "subterranean formation" encompasses both areas below exposed earth and areas below earth covered by water such as ocean or fresh water. Herein in the disclosure, "top" means the well at the surface (e.g., at the wellhead which may be located on dry land or below water, e.g., a subsea wellhead), and the direction along a wellbore towards the well surface is referred to as "up"; "bottom" means the end of the wellbore away from the surface, and the direction along a wellbore away from the wellbore surface is referred to as "down." For example, in a horizontal wellbore, two locations may be at the same level (e.g., depth within a subterranean formation), the location closer to the well surface (by comparing the lengths along the wellbore from the wellbore surface to the locations) is referred to as "above" the other location, the location farther away from the well surface (by comparing the lengths along the wellbore from the wellbore surface to the locations) is referred to as "below" or "lower than" the other location.

As utilized herein, a "previously-fractured" wellbore comprises an existing wellbore that has previously had (e.g., multi-stage) hydraulic fracturing applied thereto.

Simulfrac is a term used in the oil and gas industry, specifically in the context of hydraulic fracturing operations. It stands for "simultaneous fracturing" and refers to a method where multiple hydraulic fracturing treatments are conducted simultaneously, for example on multiple wellbores or stages or sections of a wellbore. Conventionally, with simulfrac operations, pumping down two wells is performed while perforating another two wells, allowing completion of more lateral footage in the same amount of time relative to zipper-frac operations. Via simulfrac completions, for example, two horizontal wells can be stimulated at the same time using a single fracturing fleet. This disclosure provides methods of simultaneously refracturing at least two previously-fractured wells. As utilized herein, "simultaneous refracturing" or "simulfrac" refers to fracturing (e.g., refracturing) more than one previously-fractured wellbore (e.g., at least two previously-fractured wellbores or one previously-fractured wellbore and one wellbore that has not previously been fractured) at the same time. In embodiments, simultaneously refracturing can include treating a bullhead refrac alongside zippering two new wells (e.g., three wells total, with the refrac and one of the new wells being pumped in simultaneously through the treatment). The fracturing of the plurality of wellbores has to overlap for at least a portion of a duration of the fracturing (e.g., and not the totality thereof) to be considered simultaneous refracturing according to this disclosure. As the herein disclosed methods are directed to refracturing previously-fractured wellbores via the introduction thereto of a fracturing fluid, the refracturing may be simply referred to in instances as "fracturing" rather than "refracturing" and the proppant-containing fluid referred to as a "fracturing" fluid rather than a "refracturing" fluid.

As utilized herein, a "lateral" well or "lateral" refers to the non-vertical (e.g., horizontal) section of a wellbore, extending from a main vertical shaft. These deviations from vertical (e.g., horizontal) extensions can serve to enable operators to tap into larger portions of oil and gas reservoirs. Although sometimes referred to as "horizontal" herein, the wellbores refractured according to the methods of this disclosure can have any angle from vertical (e.g., from about 10 to about 170 degrees from vertical, that is heading toward or away from a surface of the earth from the heel to the toe of the portion of the wellbore being refractured). As used herein, a lateral is thus a section of a wellbore that deviates from a main or vertical wellbore.

"Simultaneous" and "concurrent" are utilized interchangeably herein.

"Bullhead refracturing" is a method used in hydraulic fracturing (frac) to recover additional reserves by pumping water and diverters into an (e.g., un-isolated portion of a lateral of a) wellbore to increase production in under-stimulated zones. It involves pumping down the original casing through the original perforations (e.g., with no mechanical isolation introduced into the original casing), and may thus be considered treating the entire lateral in a single stage." "Bullhead refracturing" is thus a process that can be utilized to re-stimulate a previously-fractured by pumping a fracturing fluid (e.g., water and/or proppant) and diverters into an un-isolated wellbore to increase production with the aim of recovering additional reserves. "Un-isolated" in reference to bullheading can refer to sections of the lateral (horizontal), not the wellbore specifically. The wellbore can be a wellbore without specific frac stage isolation, or a wellbore that is not segmented by treatment stages; an open wellbore.

The large scale horizontal refracturing market is bifurcated into two primary methods. The first comprises a bullhead treatment stimulation pumped into the existing wellbore, and the second utilizes a multi-stage plug and perforation (e.g., "plug and perf") stimulation that is pumped into a new wellbore configuration that mechanically isolates the lateral (e.g., which is typically a smaller sized liner cemented in place). While the former of these methods can be significantly simpler in operation and lower in total expenditure, the latter of the two methods typically provides higher production increases, with better predictability.

The challenge of the bullhead refracturing treatment that most hinders the production results is the inconsistency of stimulating an (entirely or at least partially) open wellbore in a uniform manner. It is to be noted that the entire wellbore does not need to be open insomuch as a large segment of the lateral is still open. For example, if there was an obstruction or plug mid-way through the wellbore that isolated off the toe portion, the herein disclosed methodology can still be suitable. During bullhead refracturing treatments, a disproportionate amount of the treatment volume can be stimulating the heel-side of the wellbore. This can occur for a variety of reasons, that can include, without limitation: (1) it is often that the heel-side portion of the wellbore has experienced the most depletion of pressure via production; (2) the heel portion of the lateral is the first portion of the reservoir that is encountered by the treatment as it is pumping; (3) sand or proppant blockages may form during the treatment in the lateral portion of the wellbore thus isolating more distal portions of the lateral from the stimulation treatment; and (4) treating further down the lateral requires overcoming higher friction pressures generated from pipe friction. This disclosure provides methods of bullhead refracturing that address both the economic challenge of refracturing, which can be addressed via the methods of this disclosure by using a methodology that does not require a reconfiguration of the wellbore construction, and the treatment uniformity challenge of refracturing, which can be addressed via the methods of this disclosure by implementing methodologies that promote better uniformity of the stimulation across the lateral.

The solution proposed by the herein disclosed methods help foster greater coverage across refracturing wells via two disparate, yet combinable, strategies. In a first strategy, simultaneously fracturing (e.g., two) adjacent (e.g., at least partly parallel) wellbores at the same time, can induce stresses (e.g., in one wellbore) that can create a potential leakoff resistance/barrier in another/adjacent well, thereby stimulating more overall sections of the wellbores/laterals and different rock volumes of the formation. While stimulation of the two wellbores remains simultaneous, dynamic movement of the stimulated clusters of one well can continue to have dynamic stress influence on the other/adjacent well(s), thereby creating a cycle of greater coverage during the refracturing treatment as compared to a conventional bullhead treatment of a single well. By simultaneously performing multiple (e.g., two) bullhead treatments, the overall cost of the refracturing can be reduced relative to refracturing treatment methods that include running a cemented liner in one or both of the wells.

Via a second strategy, prior to refracturing the wellbore(s) with a bullhead proppant treatment, a temporary sealant can be placed in the wellbore(s), being spotted at the heel section, and being allowed to partially leak off into the existing fracture clusters. Once set, the wellbore portion can be washed out and the sealant chemistry can provide a temporary resistance to frac treatment by creating a seal immediately adjacent to the wellbore, just inside the perforation clusters and previously propped fractures. During the bullhead refracturing treatment, the sealant can act as a temporary barrier to fracture fluid penetration, and thus force the fracturing treatment farther down the wellbore(s), past the heel section(s) and toward the toe(s). As the refracturing treatment progresses, the heel can later be accessed by introducing sealant remover (e.g., acid) into the well(s) (e.g., into the treatment fluid/fracturing fluid), thereby degrading the barrier that exists at the heel, and allowing the fracturing treatment to penetrate the heel section previously blocked by the sealant barrier.

As noted above, in embodiments, a method of this disclosure employs simulfrac operations in the treatment of one or more bullhead treatments for wells that have previously been fractured (i.e., "refrac wells"). Via the simultaneous pressurizing of two (or more) adjacent wells, stress fields can be induced in the rock structure. The induced stress in regions can enable improved lateral coverage to be obtained by the bullhead refracturing treatment relative to conventional, single well bullhead refrac operations, which typically do not provide good lateral coverage (e.g., refracturing along the entire length of the lateral from the heel to the toe). By deploying the use of simulfracturing technology, and thus utilizing a single fleet pumping into a plurality of (e.g., two or more) wells at the same time, the efficiency of the refracturing operations, the cost of project, and/or the effectiveness of the stimulation treatment can be improved.

As noted, in embodiments, a method of this disclosure comprises simultaneously performing bullhead refracturing operations on a plurality of previously-fractured wellbores. In original completions, perforations are made through the casing, thus making holes in the casing. A challenge with refracturing is re-isolating the wellbore. Bullhead refracturing does not rely on mechanical isolation (e.g., using straddle isolation, expandable liners, placement of a new, reduced diameter tubing string, or the like), making isolation more difficult during bullhead refracturing operations.

Via the use of diverters, a fracturing fluid/job can be pumped into a wellbore and one or more regions can take all or most of the fracturing fluid. Once the first stage is fractured, a diverter fluid can be introduced into the wellbore and will enter the refractures that are accepting the fluid and the diverter fluid will block off those regions from the rest of the well. Once the diverter is in place, it can force the subsequently introduced fracturing fluid to enter another region during a subsequent (e.g., second and so on) stage of the refracturing. Once each stage of the refracturing is effected, the diverter can be introduced to block off that stage and force the subsequently introduced fracturing fluid to move along the length of the wellbore being refractured. This is described hereinbelow with reference to FIGS. 5C-5K. Via this disclosure, a method can comprise bullhead refracturing of a plurality of adjacent wellbores (e.g., as described hereinbelow with reference to FIG. 2A and FIG. 2B) at least partially simultaneously.

In embodiments, a method of this disclosure comprises: (a) introducing a fracturing fluid into each of a plurality of previously-fractured wellbores, wherein the fracturing fluid induces fractures in at least one zone of at least one of the plurality of wellbores, and wherein the fracturing fluid is introduced into each of the plurality of previously-fractured wellbores concurrently/simultaneously for at least a portion of a duration of the introducing; (b) introducing a diverter fluid into each of the plurality of previously-fractured wellbores, wherein the diverter fluid flows into the induced fractures of the at least one zone, reducing flow thereto, and wherein the diverter fluid is introduced into each of the plurality of previously-fractured wellbores concurrently/simultaneously for at least a portion of a duration of the introducing; and (c) repeating (a) and (b). The repeating of (a) and (b) can be performed, for example, until each of the plurality of previously-fractured wellbores has been refractured or another issue ceases the refracturing of one or more of the plurality of previously-fractured wellbores.

The plurality of previously-fractured wellbores are adjacent in that they are positioned relative to one another such that regions of induced pressure/stress produced by the concurrent introduction of the fracturing fluid promote/enhance/encourage the at least one zone being fractured in (a) to proceed along the length of the wellbores toward the toes thereof by the end of the refracturing (e.g., by the end of the repeating in (c)), thus improving uniformity of the refracturing operation.

With reference now to FIG. 1, which is a schematic illustration of a two-well example 100 of simultaneous bullhead refracturing, according to embodiments of this disclosure, a single fracturing spread 90, which can comprise frac pumps 95 and a blender 96 and other associated equipment, is utilized according to embodiments of this disclosure for introducing the fracturing fluid into each of previously-fractured wellbore 110A and previously-fractured wellbore 110B in (a) and the introducing of the diverter fluid into each of previously-fractured wellbore 110A and previously-fractured wellbore 110B in (b). The previously-fractured wellbore 110A and previously-fractured wellbore 110B have been previously-fractured, as indicated via prior fractures/perforations 120. Refractured zones 130A and 130B contain induced fractures 125 produced during the refracturing.

Previously-fractured wellbore 110A comprises a vertical section 115A and a deviated or horizontal section 117A extending from a heel 112A to a toe 113A and having a length L, and previously-fractured wellbore 110B comprises a vertical section 115B and a deviated or horizontal section 117B extending from a heel 112B to a toe 113B and having a length L. It is to be noted that, although both previously-fractured wellbore 110A and previously-fractured wellbore 110B have horizontal sections 117A and 117B, respectively, having a same length L, previously-fractured wellbore 110A and previously-fractured wellbore 110B can have different lengths L, so long as at least a portion of the length thereof is close enough to the adjacent wellbore such that regions of induced stress are produced by the simultaneous refracturing.

In the example schematic of FIG. 1, the simultaneous refracturing has resulted in previously-fractured wellbore 110A containing refracture zones 130A adjacent the heel 112A thereof. The flow of refracturing fluid into the refracture zones 130A of wellbore 110A has induced stress in region 140A of wellbore 110B, such that the fracturing fluid has moved further along the lateral 117B of wellbore 110B, providing refracture zones 130B that are farther from heel 112B of wellbore 110B relative to refracture zones 130A of wellbore 110A. The flow of the fracturing fluid into refracture zones 130B of wellbore 110B has similarly induced stress in induced stress region 140B of wellbore 110A, which can, during a subsequent simultaneous introduction of fracturing fluid into wellbore 110A and wellbore 110B push the fracture stimulation of wellbore 110A toward the toe relative to induced stress region 140B. Due to the induced stress regions, the flow of the fracturing fluid being introduced into the wellbores at (a) can promote fracture stimulation to be distributed along a greater length L of each of the wellbores 110 (e.g., wellbore 110A and wellbore 110B), thus resulting in a greater fracture coverage than a conventional bullhead refracture of a single wellbore. That is, as noted hereinabove, the regions of induced pressure/stress 140 (e.g., 140A and 140B shown in the embodiment of FIG. 1) produced by the concurrent introduction of the fracturing fluid can promote/enhance/encourage the at least one zone being fractured in (a) to proceed along the length of the wellbores 110 toward the toes 113 thereof by the end of the refracturing (e.g., by the end of the repeating in (c)).

Figure 2A:
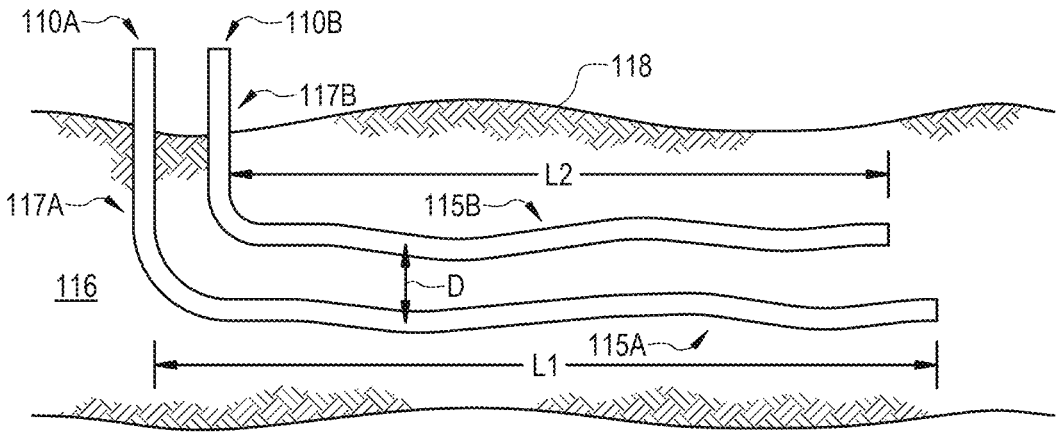
FIG. 2A is a schematic side-view illustration of adjacent wellbores suitable for simultaneous bullhead refracturing, according to embodiments of this disclosure.
Figure 2B:
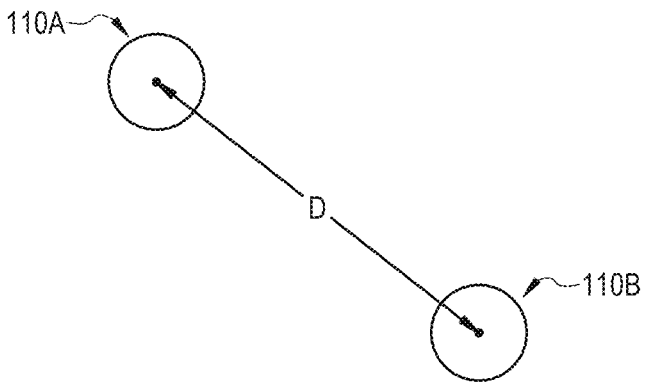
FIG. 2B is a schematic gun barrel view of adjacent wellbores suitable for simultaneous bullhead refracturing, according to embodiments of this disclosure.

The plurality of previously-fractured wellbores are adjacent in that they are positioned relative to one another such that the regions of induced stress 140 are produced. For example, with reference to FIG. 2A, which is a schematic side-view illustration of adjacent wellbores 110A and 110B suitable for simultaneous bullhead refracturing, according to embodiments of this disclosure, and FIG. 2B, which is a schematic top-down view of adjacent wellbores 11A and 110B suitable for simultaneous bullhead refracturing, according to embodiments of this disclosure, each of the plurality of wellbores 110 can be positioned such that a distance, D, is, at some point along the length L of the lateral(s) thereof, such that the regions of induced stress 140 (e.g., 140A and 140B in the schematic of FIG. 1) affect the flow of the fracturing fluid along at least a portion of the length of the wellbore. The method can be performed on wells on the same pad location or immediately adjacent, in embodiments. In embodiments, each of the previously-fractured wellbores 110 is positioned within at least about 60, 90, 120, 150, 180, 210, 240, 270, 300, 450, or 600 meters (about 200, 300, 400, 500, 600, 700, 800, 900, 1000, 1500, or 2000 feet) from another of the previously-fractured wellbores along at least a portion of a length L thereof being refractured. For example, in embodiments, D can be less than or equal to about 600, 450, 300, or 150 meters (2000, 1500, 1000, or 500 feet). While application of the methods of this disclosure with wellbores placed in different formation targets is depicted in FIG. 2A, the concepts of this disclosure also apply to wellbores within the same target formation, as will be apparent to those of skill in the art and with the help of this disclosure.

It is to be noted that the lateral(s) of the adjacent wellbores can be positioned in a same or a disparate pay zone or geological layer within a reservoir rock where commercially viable amounts of oil or natural gas are found. Also, although shown as at disparate depths in FIG. 2A, the lateral(s) can be at a same depth from surface 118; that is, the adjacent wellbores 110A and 110B can comprise lateral(s) that are relatively above and below one another or side by side, so long as the simultaneous introduction of the fracturing fluid during the simultaneous refracturing induces the induced stress regions to promote the stimulation coverage along the lateral(s).

Figure 3:
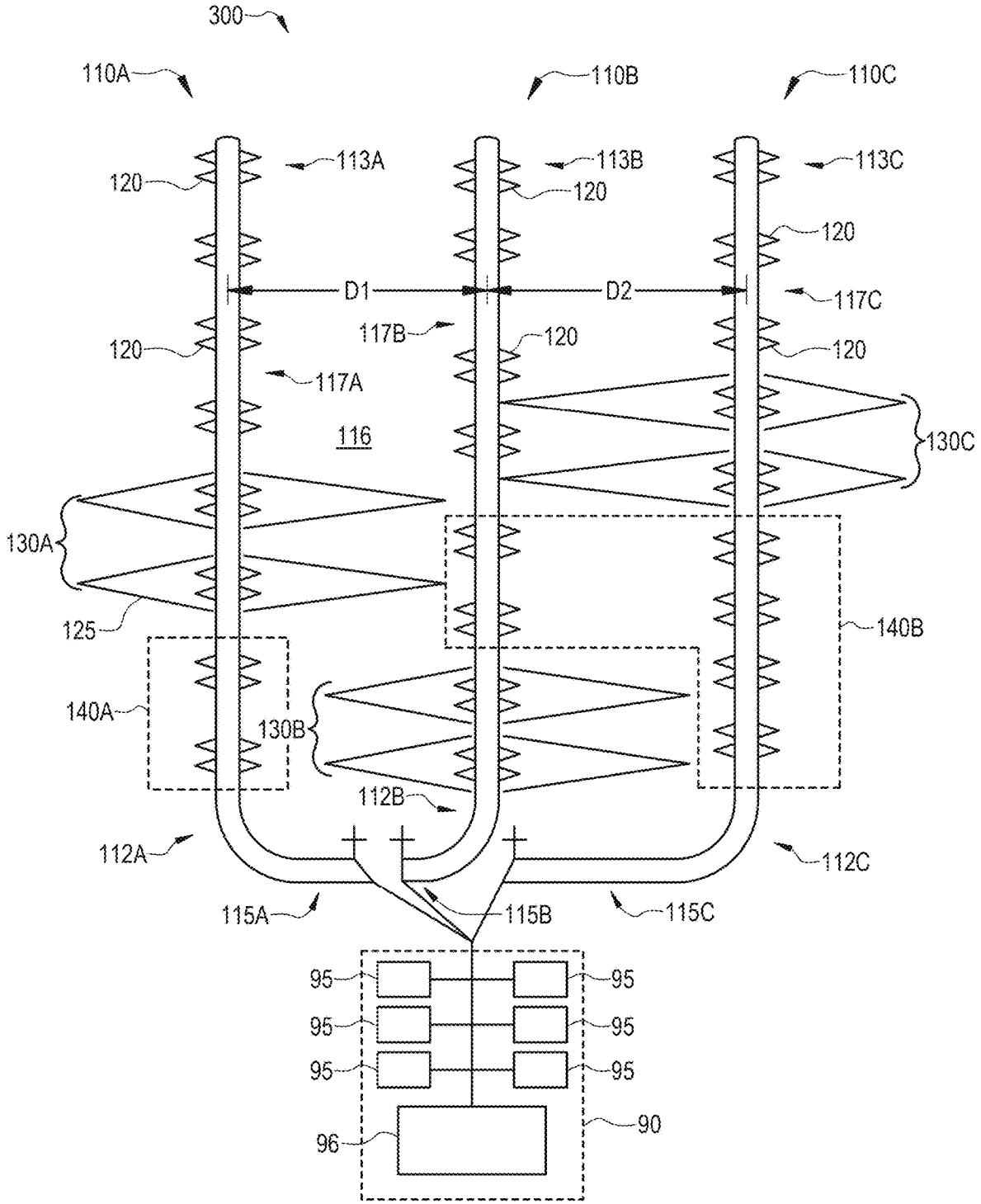
FIG. 3 is a schematic illustration of a three-well example of simultaneous bullhead refracturing, according to embodiments of this disclosure.

As noted above, a plurality of adjacent wellbores 110 can be refractured according to embodiments of the herein disclosed method. The plurality of adjacent wellbores 110 can include 2, 3, 4, or more wellbores, so long as each of the adjacent wellbores 110 is located close enough to at least one other of the plurality of wellbores 110 such that induced stress regions 140 are produced by the simultaneous introduction of the fracturing fluid and promote the stimulation along the wellbore length. In embodiments, the plurality of previously-fractured wellbores consists of two wellbores (i.e., a first wellbore and a second wellbore), three wellbores, four wellbores, or more. By way of further example, FIG. 3 is a schematic illustration of a three-well example 300 of simultaneous bullhead refracturing, according to embodiments of this disclosure. In the embodiment of FIG. 3, wellbore 110A is positioned a distance D1 from wellbore 110B along at least a portion of the length L thereof, and wellbore 110B is positioned a distance D2 from wellbore 110C along at least a portion of the length L thereof, such that simultaneous introduction of the fracturing fluid into the wellbores 110A/110B/110C induces stress regions 140 in one or more of the wellbores 110 to affect the flow of the fracturing fluid therethrough.

In the example of FIG. 3, an induced stress zone or region 140A is located in the heel 112 region of wellbore 110A, refracture zones 130B are located in the heel 112B region of wellbore 110B, and an induced stress region or zone 140B is located in the heel 112C region of wellbore 110C. Refracture zones 130A are located down the length L (e.g., toward the toe 113A and away from the heel 112A) of wellbore 110A, induced stress region 140B extends down from (e.g., down the length L (e.g., toward the toe 113B and away from the heel 113A) of wellbore 110B) of wellbore 110B relative to refracture zones 130B of wellbore 110B. Induced stress region 140B extends down the length L (e.g., toward the toe 113C and away from the heel 112C) of wellbore 110C from heel 112C to refracture zones 130C of wellbore 110C, which refracture zones 130C are closer to toe 113A than refracture zones 130A of wellbore 110A.

In the example of FIG. 3, flow of the fracturing fluid into wellbore 110B may have resulted in refracture zones 130B in the heel 112B region of wellbore 110B which induced stress regions 140A in wellbore 110A and 140B in wellbore 110C, such that refracture zones 130A of wellbore 110A are located farther down the length L of wellbore 110A than refracture zones 130B of wellbore 110B, and refracture zones 130C of wellbore 110C are located farther down the length L of wellbore 110C than refracture zones 130A of wellbore 110A. Again, the schematic of FIG. 3 and example description thereof is meant to be solely by way of example. The fracturing fluid 155 (FIGS. 4A-5K) will preferentially enter the zones of least resistance, and the induced stress zones 140 produced by the entrance of the fracturing fluid 155 in the zones of least resistance will concomitantly alter the flow of the fracturing fluid 155 along the length of the adjacent well(s) 110. Regardless of the exact order of production of the refracture zones 130, the net effect will be an increased overall stimulation (e.g., greater heel to toe coverage) of the wellbores 110 via the simultaneous refracturing provided by the methods of this disclosure relative to a single bullhead refracturing of a single wellbore. For example, refracture zones 130A of FIG. 3 could have been formed at an earlier stage in the refracturing operation than (or concomitantly with) refracture zones 130B of wellbore 110B and/or refracture zones 130C of wellbore 110C.

In embodiments, as described further hereinbelow with reference to FIGS. 4A-5K, a sealant can be utilized to direct the subsequent flow of the fracturing fluid 155 (for example, away from the heel 112 regions thereof) into one or more of the wellbores. In such embodiments, the method can further comprise introducing a (e.g., temporary) sealant into at least one wellbore of the plurality of previously-fractured wellbores (e.g., one or each of the plurality of previously-fractured wellbores), whereby the sealant forms a barrier to flow (e.g., at least partly seals off flow) to a region proximal a heel of the at least one wellbore. In embodiments, the method comprises introducing the sealant into each of the plurality of previously-fractured wellbores The method can comprise introducing the sealant into each of the plurality of previously-fractured wellbores simultaneously into two or more of the wellbores during at least a portion of a duration of the introducing of the sealant. As detailed further hereinbelow, the sealant can comprise a conformance fluid, such as and without limitation, a high viscosity fluid such as a cross-linked polymer of the type used for wellbore fluid loss control, such as TEMBLOK™, or another (e.g., commercially available) system with crosslinkable polymers, such as K-MAX™, which can be made from a specially derivatized hydroxyethylcellulose (HEC) that can be crosslinkable in a variety of brines ranging from, for example, 8 to 14 lb/gal. In embodiments in which a sealant is utilized, the method can further comprise introducing a sealant remover (e.g., acid; fracturing/treatment fluid with added sealant remover) into the at least one wellbore such that the barrier to flow is at least partly removed. Subsequent removal of the barrier to flow, fracturing fluid can be introduced into the at least one wellbore (e.g., simultaneous flow of the fracturing fluid into each of the plurality of wellbores or into each of the at least one wellbore into which the sealant barrier was placed) whereby flow of the fracturing fluid into the region proximal/adjacent the heel induces fractures therein.

In embodiments, the diverter is at least partly removed during repetition of (a) and (b) at (c) (e.g., due to time or the introducing at (a) and/or (b)). Alternatively or additionally, the method can further include, subsequent (c), introducing a fluid (a "diverter remover" fluid) into the plurality of previously-fractured wellbores to at least partly remove (e.g., disintegrate) the diverter. The diverter remover fluid can comprise any suitable diverter remover fluid, which can be introduced along with the fracturing fluid, or disparately therefrom.

Upon completion of the refracturing (i.e., subsequent (c)) the method can further comprise producing via at least one of the refractured wellbores (e.g., pumping formation fluid to surface 118 via at least one of the plurality of refractured wellbores 110).

As noted hereinabove, in embodiments of the herein disclosed method, a removable, temporary sealant product can be introduced into the heel or near-heel sections of at least one or each lateral prior to refracturing. In embodiments, a single wellbore can be refractured with the use of the sealant as described herein. In embodiments, the temporary sealant barrier can be utilized in conjunction with the simultaneous refracturing method described hereinabove with reference to FIGS. 1-3. In such embodiments, the removable, temporary sealant product can be introduced into the heel or near-heel sections of at least one or each lateral being simultaneously refractured prior to executing the simulfrac refrac bullhead treatment previously described. Methods including the use of the temporary sealant barrier can include pumping a conformance fluid or "sealant" (e.g., TEMBLOK™, described below, or similar) into the wellbore(s) at a predetermined displacement volume to allow the product to be placed into the heel portion(s) of the wellbore(s). After the product has (e.g., fully) set (e.g., typically a few hours to a couple days), a cleanout run can be performed on the wellbore(s) to remove the product (the "sealant barrier"). Once cleaned out, the bullhead simulfrac treatment can be continued, for example as previously described or elsewise. Due to the sealant nature of the product, the heel portion of each lateral treated with the sealant can be resistant to taking up the bullhead refracturing fluid. Accordingly, the refracturing fluid can then travel past the heel section of the lateral and thus proceed to stimulate more distal portions (e.g., regions closer to the toe and away from the heel). Once a predetermined volume of treatment has been achieved with the simulfrac refrac, a removal process can be initiated by sweeping volumes of a sealant remover (e.g., an acid; treatment fluid with added sealant remover/acid) into the wellbore, thereby quickly deteriorating the sealant barrier. Upon the deterioration of the sealant flow barrier, the heels of the wellbores being treated can subsequently be accessed by the refracturing fluid with limited resistance, thereby concluding the refracturing treatment with effective stimulation of the heel portions of the lateral(s).

Accordingly, in embodiments, a method (e.g., of refracturing (e.g., bullhead refracturing) at least one previously-fractured wellbore, comprises: (a) introducing a sealant into at least one previously-fractured wellbore (e.g., one or each) of a plurality of previously-fractured wellbores, whereby the sealant forms a barrier to flow (e.g., at least partly seals off flow) to a region proximal a heel of the at least one wellbore; (b) introducing a fracturing fluid into the at least one previously-fractured wellbore, wherein the fracturing fluid induces fractures in at least one zone of the at least one wellbore; (c) introducing a diverter fluid into the at least one previously-fractured wellbore, wherein the diverter fluid flows into the induced fractures of the at least one zone, reducing flow thereto; and (d) repeating (b) and (c) (e.g., until the at least one previously-fractured wellbore has been refractured); and (e) introducing a sealant remover (e.g., acid) into the at least one wellbore such that the barrier to flow is at least partly removed. As noted herein, a previously-fractured wellbore comprises an existing wellbore that has previously had (e.g., multi-stage) hydraulic fracturing applied thereto.

In embodiments, the sealant can be utilized in conjunction with the simultaneous refracturing as described hereinabove with reference to FIGS. 1-3. In such embodiments, for example, the at least one previously-fractured wellbore comprises at least two previously-fractured wellbores, and: (a) can comprise introducing the sealant into each of the at least two previously-fractured wellbores simultaneously during at least a portion of a duration of the introducing of the sealant; (b) can comprise introducing the fracturing fluid into each of the at least two previously-fractured wellbores simultaneously during at least a portion of a duration of the introducing of the fracturing fluid; (c) can comprise introducing the diverter fluid into the at least two previously-fractured wellbores simultaneously during at least a portion of a duration of the introducing of the diverter fluid; and/or (e) can comprise introducing the sealant remover (e.g., acid) into the at least two wellbores simultaneously during at least a portion of a duration of the introducing of the sealant remover.

The method can further comprise, subsequent (e), introducing fracturing fluid into the at least one wellbore, whereby flow of the fracturing fluid into a region proximal/adjacent the heel induces fractures therein.

As noted hereinabove, once the refracturing is complete, hydrocarbons can be produced from the refractured wellbore(s). For example, the method can further include, subsequent (e), pumping formation fluid to surface 118 via the at least one (e.g., now refractured) wellbore 110.

Figure 4A:
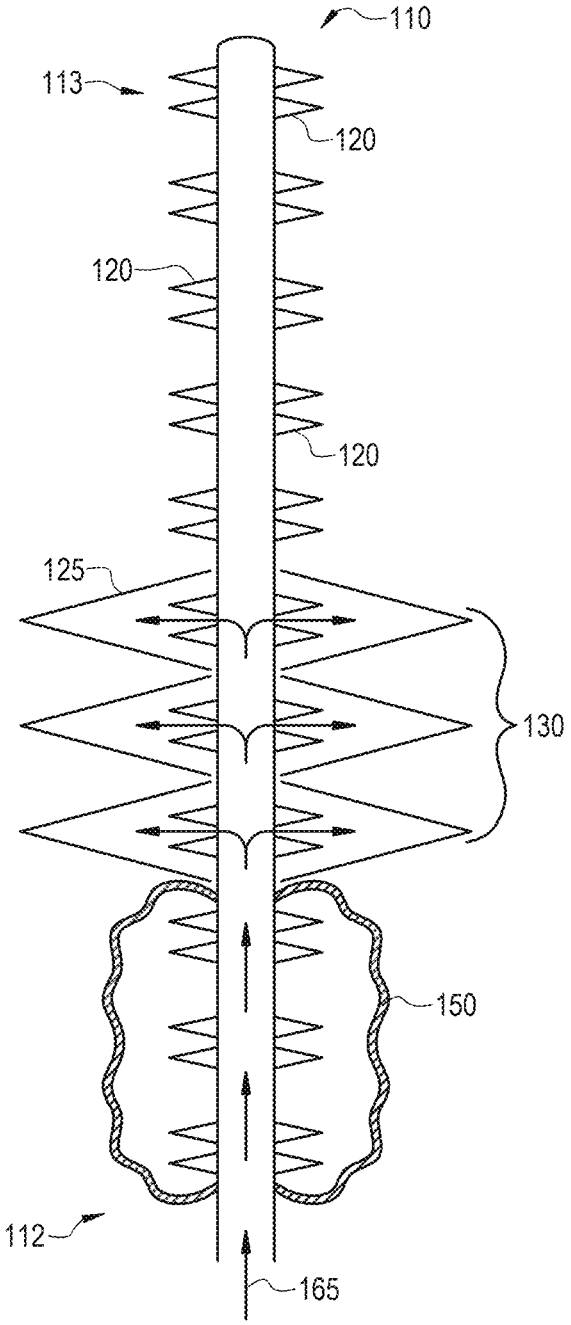
FIG. 4A is an exemplary schematic of a wellbore during refracturing with a temporary sealant barrier, after positioning of the sealant barrier, according to embodiments of this disclosure.
Figure 4B:
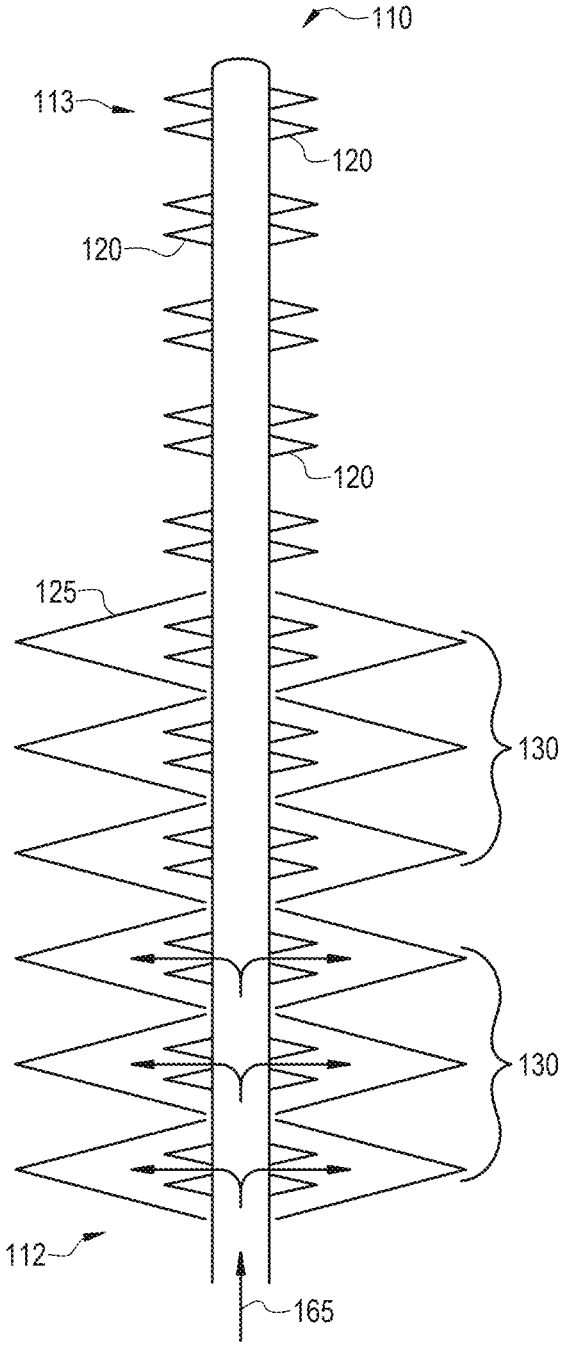
FIG. 4B is a schematic of a wellbore during refracturing with a temporary sealant barrier, after removal of the sealant barrier and during refracturing of the heel region, according to embodiments of this disclosure.

With reference now to FIG. 4A, which is an exemplary schematic of a wellbore 110 during refracturing with a temporary sealant barrier 150, after positioning of the sealant barrier 150, according to embodiments of this disclosure, at (a) sealant can be introduced into a previously-fractured wellbore 110, whereby the sealant forms a barrier 150 to flow (e.g., at least partly seals off flow) to a region proximal a heel 112 of the at least one wellbore 110. A fracturing fluid can then be introduced, at (b), into the at least one previously-fractured wellbore 110, wherein the fracturing fluid induces fractures in at least one refracturing zone 130 of the at least one wellbore 110; a diverter fluid can then be introduced (at (c)) into the at least one previously-fractured wellbore 110, wherein the diverter fluid flows into the induced fractures of the at least one refracture zone 130, reducing flow thereto; and (b) and (c) can be repeated (at (d)) (for example, until the at least one previously-fractured wellbore 110 has been refractured. A sealant remover (e.g., acid) can be introduced into the at least one wellbore 110 such that the sealant barrier 150 to flow is at least partly removed. FIG. 4A captures the refracturing operation at a point (e.g., relatively early) in the refracturing, after sealant barrier 150 has been positioned in the near heel 112 region and fracturing fluid 155 is flowing into refracture zones 130. With reference to FIG. 4B, which is a schematic of the wellbore 110 of FIG. 4A after removal of the sealant barrier 150 and refracturing of the heel 112 region and introduction of fracturing fluid 155 into refracture zones thereof, according to embodiments of this disclosure, subsequent the removal of the sealant barrier 150 at (e), fracturing fluid can be introduced into the at least one wellbore 110, whereby flow of the fracturing fluid into a region proximal/adjacent the heel 112 induces fractures therein (i.e., the heel 112 region is refractured). In embodiments, the sealant remover is added to the fracturing fluid, such that the sealant remover can be added to the wellbore 110 along with the fracturing fluid during the sealant removal. If the refracturing of the heel 112 is done during the completion of the refracturing, (b) and (c) can be completed until the refracturing of wellbore 110 is completed. The diverter can then be removed and production restarted. Thus, subsequent (e), pumping formation fluid 119 from the formation 116 to surface 118 via the at least one (e.g., now refractured) wellbore 110 can be (re)commenced.

Figure 5A:
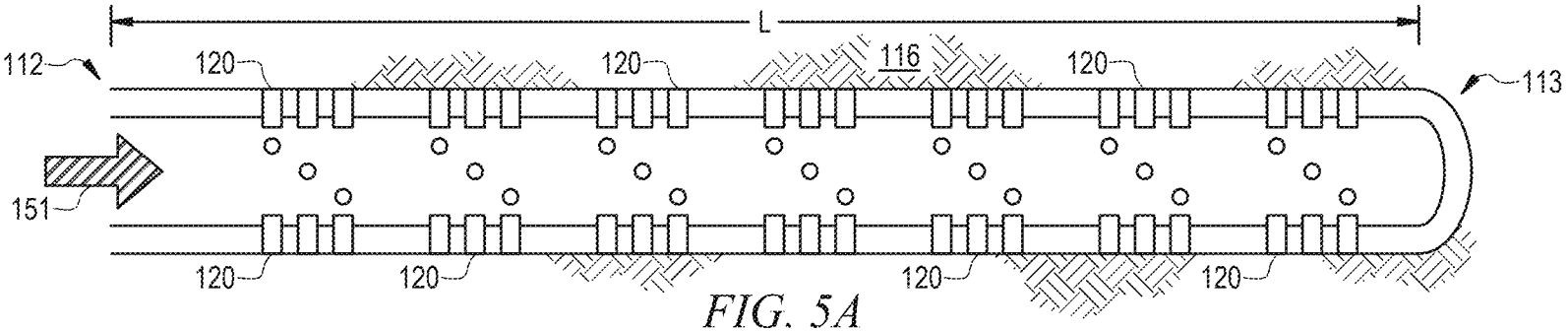
FIG. 5A is a schematic illustration of a previously-fractured wellbore at the early stage of refracturing, according to embodiments of this disclosure.
Figure 5B:
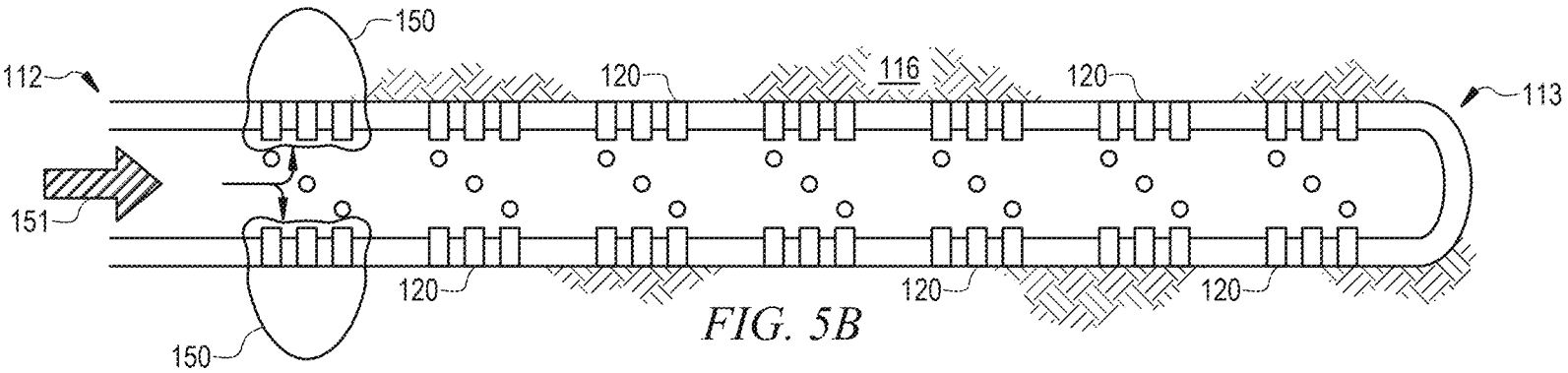
FIG. 5B is a schematic illustration of the wellbore of FIG. 5A at a subsequent time during the refracturing, after placement of a temporary barrier, according to embodiments of this disclosure.
Figure 5C:
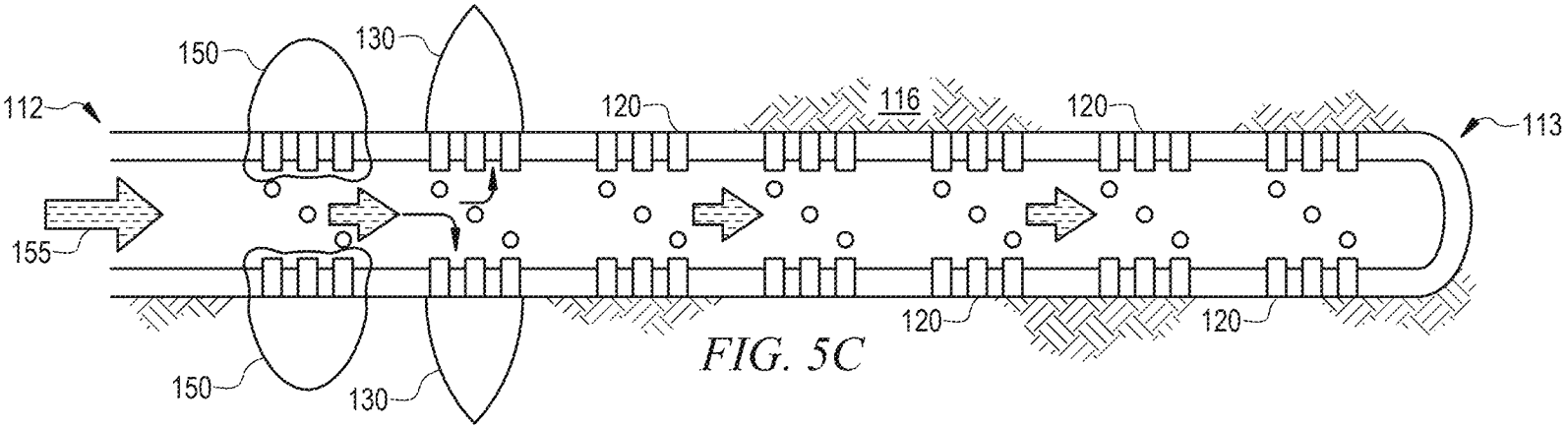
FIG. 5C is a schematic illustration of the wellbore of FIG. 5B at a subsequent time during the refracturing when fracturing fluid is being introduced into the wellbore, according to embodiments of this disclosure.
Figure 5D:
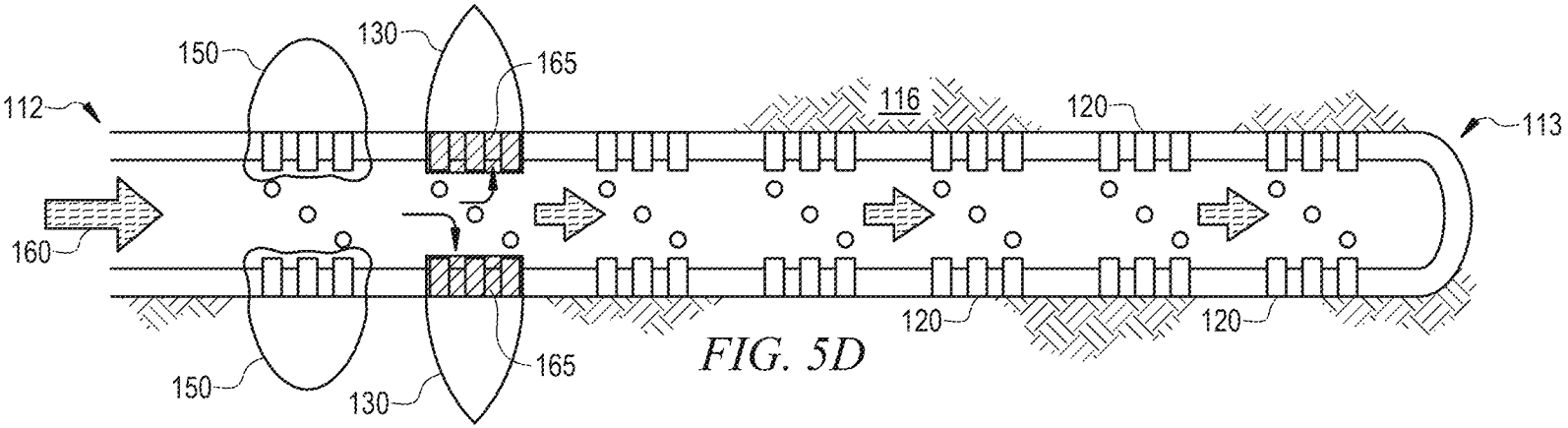
FIG. 5D is a schematic illustration of the wellbore of FIG. 5C at a subsequent time during the refracturing when diverter fluid is being introduced into the wellbore, according to embodiments of this disclosure.
Figure 5E:
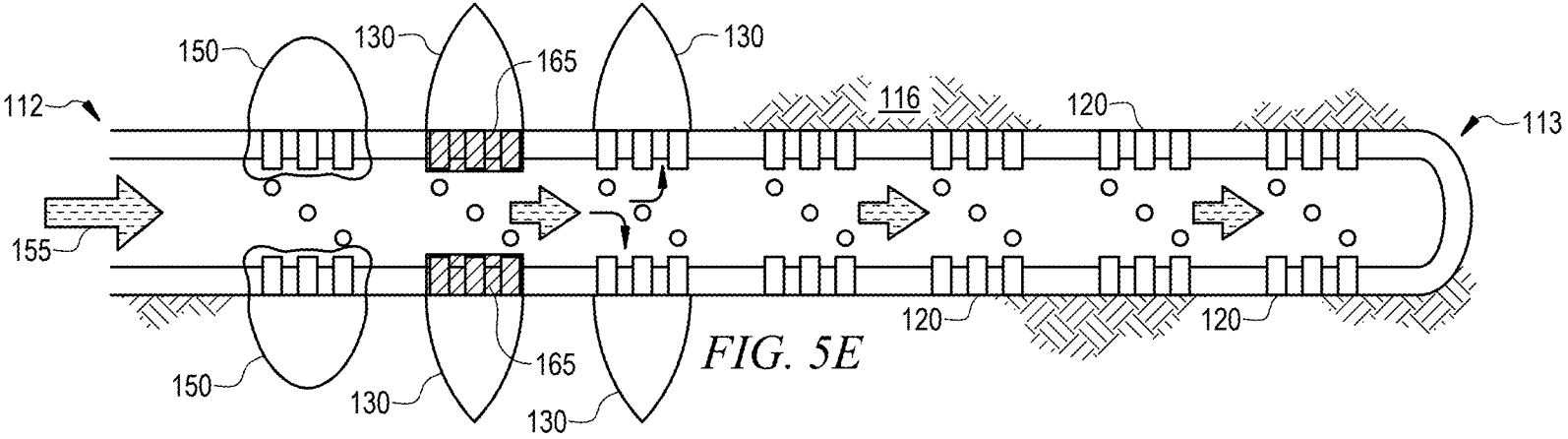
FIG. 5E is a schematic illustration of the wellbore of FIG. 5D at a subsequent time during the refracturing when fracturing fluid is again being introduced into the wellbore, according to embodiments of this disclosure.
Figure 5F:
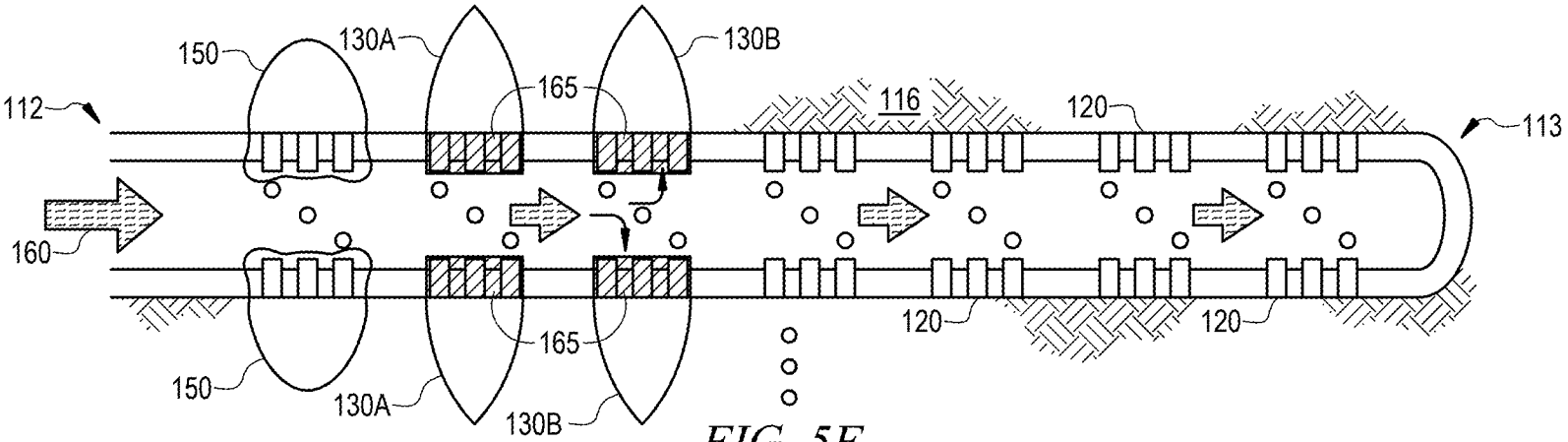
FIG. 5F is an exemplary schematic illustration of the wellbore of FIG. 5E at a subsequent time during the refracturing when diverter fluid is again being introduced into the wellbore, according to embodiments of this disclosure.
Figure 5G:
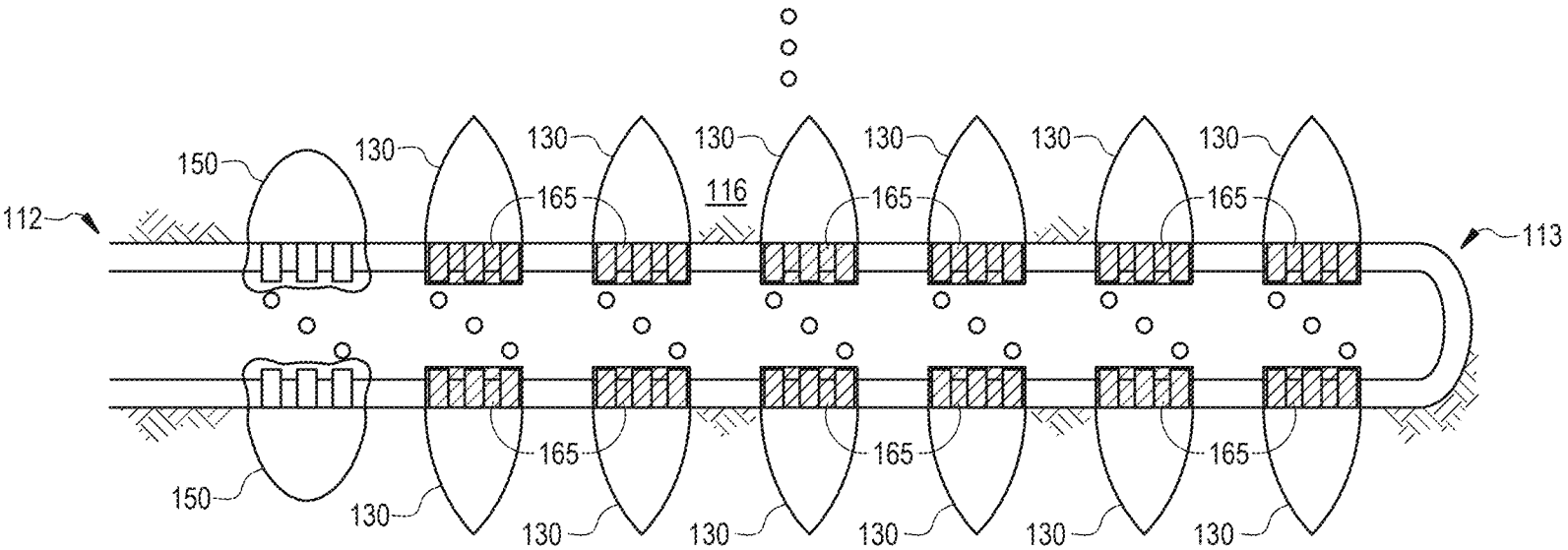
FIG. 5G is a schematic illustration of the wellbore of FIG. 5F at a late stage of the refracturing, according to embodiments of this disclosure.
Figure 5H:
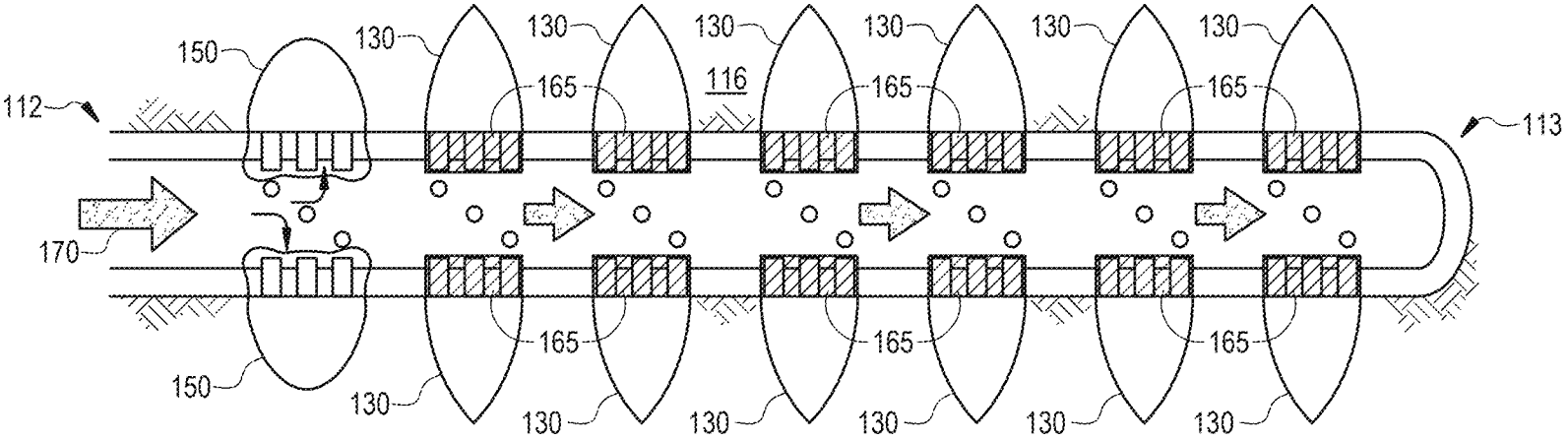
FIG. 5H is a schematic illustration of the wellbore of FIG. 5G at a time during the refracturing when sealant remover fluid is being introduced into the wellbore to remove the temporary barrier in the near-heel region, according to embodiments of this disclosure.
Figure 5I:
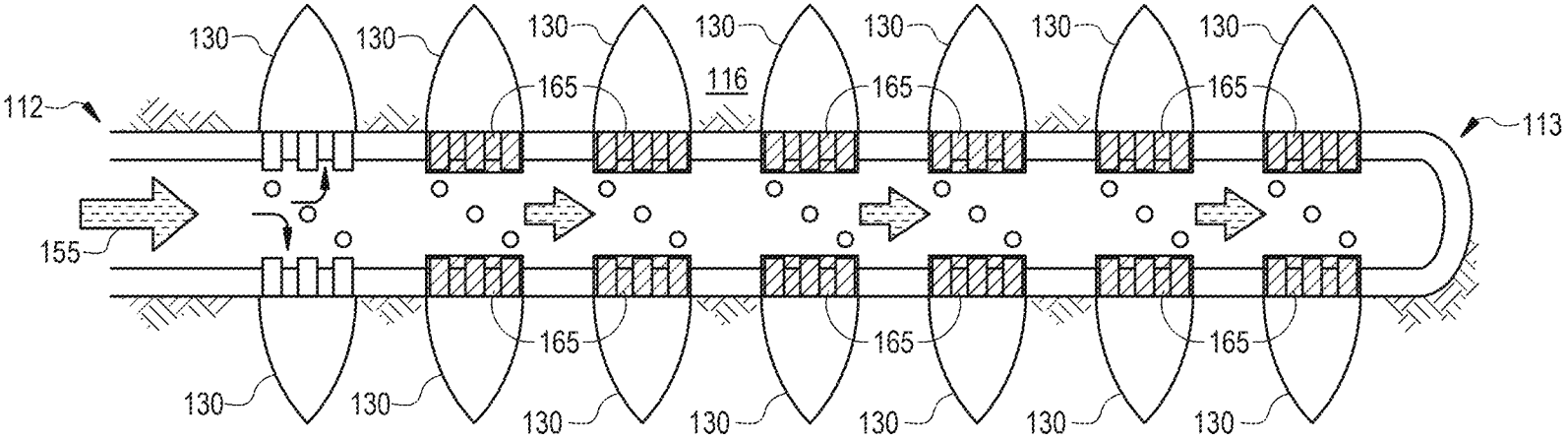
FIG. 5I is a schematic illustration of the wellbore of FIG. 5H at a time during the refracturing when fracturing fluid is again being introduced into the wellbore to refracture the near-heel region, according to embodiments of this disclosure.
Figure 5J:
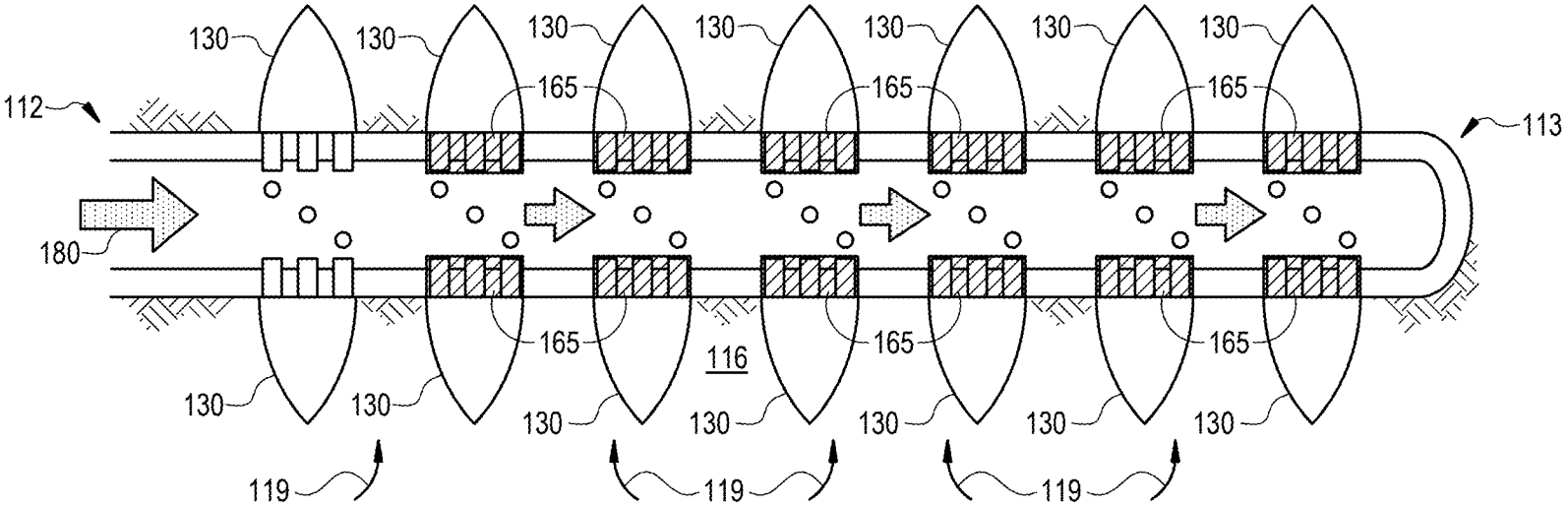
FIG. 5J is a schematic illustration of the wellbore of FIG. 5I at a time during the refracturing when a diverter removing fluid is being introduced into the wellbore to enable flow to the newly refractured zones, according to embodiments of this disclosure.
Figure 5K:
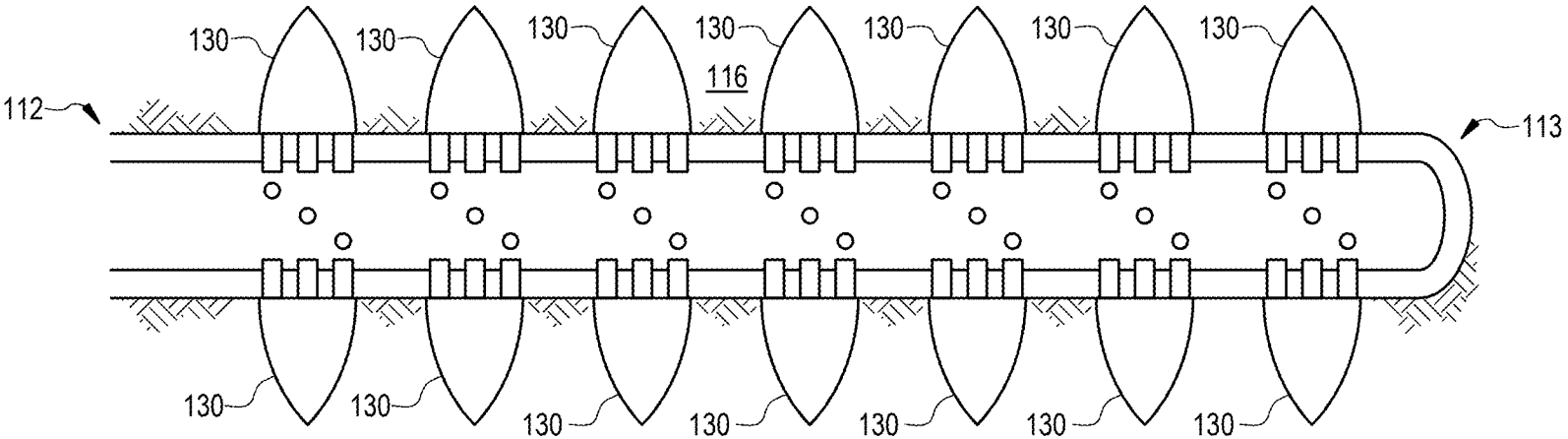
FIG. 5K is a schematic illustration of the wellbore of FIG. 5J at an end of the refracturing operation, when the wellbore has been refractured and is again suitable for production of formation fluids therethrough, according to embodiments of this disclosure.

Description of a method of refracturing according to this disclosure via the use of a sealant barrier 150 will now be made with reference to FIGS. 5A-5K, which depict a wellbore 110 during the refracturing. FIG. 5A is a schematic illustration of a previously-fractured wellbore at the early stage of refracturing, according to embodiments of this disclosure. As seen in FIG. 5A, previously-fractured wellbore 110 comprises prior perforations/fractures, indicated as 120 along a length L of the horizontal portion of wellbore 110 from heel 112 to toe 113 thereof. Sealant 151 can be introduced into wellbore 110 (e.g., at (a)), FIG. 5B is a schematic illustration of the wellbore 110 of FIG. 5A at a subsequent time during the refracturing, after placement of temporary barrier 150 formed by setting of the sealant 151. The sealant barrier 150 can serve to prevent or minimize flow of fluid (e.g., subsequently introduced fracturing fluid 155) into the near heel/heel 112 region. FIG. 5C is a schematic illustration of the wellbore 110 at a subsequent time during the refracturing when fracturing fluid 155 is being introduced into the wellbore 110 (e.g., at (b)), according to embodiments of this disclosure. The introduction of the fracturing fluid 155 forms a refracture zone(s) 130, which can be subsequent the sealant barrier 150 (or elsewhere the fracturing fluid flows). FIG. 5D is a schematic illustration of the wellbore 110 at a subsequent time during the refracturing when diverter fluid 160 is being introduced into the wellbore 110 (e.g., at (c)), according to embodiments of this disclosure. The diverter fluid serves to block the flow of fluid (e.g., subsequently introduced fracturing fluid 155) into the refracture zone 130 previously fractured, as indicated with diverter blocked flow area 165. FIG. 5E is a schematic illustration of the wellbore 110 of FIG. 5D at a subsequent time during the refracturing when fracturing fluid 155 is again being introduced into the wellbore 110 (at repeating of (b) at (d)). The fracturing fluid bypasses the sealant barrier 150 in the heel 112 region and any previously refractured zones 130 to fracture a new refracture zone 130. Again, as illustrated in FIG. 5F, which is an exemplary schematic illustration of the wellbore 110 of FIG. 5E at a subsequent time during the refracturing, diverter fluid 160 can again be introduced into the wellbore 110, to block flow into the previously refractured zone 130, as indicated at diverter reduced flow area 165. As indicated by the ellipses in FIG. 5F and FIG. 5G, the introducing of the fracturing fluid 155 and the diverter 160 can be repeated (e.g., at (d)) until the refracturing has reached the toe 113 (or the refracturing is ceased for another reason). FIG. 5G is a schematic illustration of the wellbore 110 of FIG. 5F at a late stage of the refracturing, according to embodiments of this disclosure, when refracture zones 130 extend along length L of the wellbore 110, and sealant barrier 150 is still positioned in the heel 112 region. FIG. 5H is a schematic illustration of the wellbore 110 of FIG. 5G at a subsequent time during the refracturing when sealant remover fluid 170 is being introduced into the wellbore (e.g., at (e)) to remove the temporary barrier 150 in the near-heel 112 region, according to embodiments of this disclosure. FIG. 5I is a schematic illustration of the wellbore 110 of FIG. 5H at a time during the refracturing when fracturing fluid 155 is again being introduced into the wellbore 110 to refracture the near-heel 112 region, to stimulate the near-heel 112 region. It is noted that this removal of the sealant barrier 150 can be effected prior to the conclusion of the refracturing (e.g., prior to refracture zones 130 extending to the toe 113 of wellbore 110). FIG. 5J is a schematic illustration of the wellbore 110 of FIG. 5I at a time during the refracturing when a diverter removing fluid 180 is being introduced into the wellbore 110 to remove the diverter reduced flow areas 165 and thus enable flow to the newly refractured zones 130, according to embodiments of this disclosure. FIG. 5K is a schematic illustration of the wellbore 110 of FIG. 5J at or near an end of the refracturing operation, when the wellbore 110 has been refractured and is again suitable for production of formation fluids 119 from the formation 116 therethrough, according to embodiments of this disclosure. FIGS. 5A-5K are provided as an example only. Although depicted as proceeding from heel to toe, the regions being fractured in each stage need not proceed from heel to toe during the refracturing; that is, a refracture zone can be created closer to the toe before a refracture zone is created in a portion of the wellbore closer to the heel, depending on which regions are taking the fracturing fluid. For example, when the sealant 151 is utilized with the simultaneous refracturing described herein with reference to FIGS. 1-3, the induced stress regions 140 (e.g., 140A, 140B) may encourage the refracturing of zones toward the toe 113 in advance of zones in the same wellbore in the heel 112 regions.

In embodiments, a method (e.g., of refracturing a plurality of previously-fractured wellbores comprises: (a) introducing a sealant into at least one of a plurality of previously-fractured wellbores, whereby the sealant forms a barrier to flow (e.g., at least partly seals off flow) to a region proximal a heel of the at least one of the plurality of previously-fractured wellbores; (b) introducing a fracturing fluid into each of the plurality of previously-fractured wellbores, wherein the fracturing fluid induces fractures in at least one zone of at least one of the plurality of previously-fractured wellbores; (c) introducing a diverter fluid into the plurality of previously-fractured wellbores, wherein the diverter fluid flows into the induced fractures of the at least one zone, reducing flow thereto; and (d) repeating (b) and (c) (e.g., until the plurality of previously-fractured wellbores have been refractured); and (e) introducing a sealant remover (e.g., acid) into the at least one previously-fractured wellbore of (a) such that the barrier to flow is at least partly removed. In embodiments, the diverter is at least partly removed during repetition of (b) and (c) at (d) (e.g., due to time or a the introducing at (b) and/or (c)), and/or the method can further comprise, subsequent (d), introducing a fluid into the plurality of previously-fractured wellbores to at least partly remove (e.g., disintegrate) the diverter. Again, subsequent (e), formation fluid can be produced (e.g., pumped) to surface 118 via at least one of the plurality of previously-fractured (e.g., now refractured) wellbores 110 that has been refractured as per this disclosure.

The fracturing fluids 155 utilized in the herein disclosed methods can be any fracturing fluids known to those of skill in the art and with the help of this disclosure. In embodiments, the fracturing fluids (e.g., pumped into well(s) 110) can comprise water, for example, a blend of water and a proppant, a blend of friction reducer and water, e.g., slick water, and proppant. In embodiments, the fracturing fluid can comprise linear or crosslinked gel systems with or without proppant. Any fracturing or treatment fluid comprising water and/or proppant can be introduced into one or more wells 110 according to this disclosure.

The diverter fluid 160 can be any diverter fluid known to those of skill in the art and with the help of this disclosure. In embodiments, the diverter fluid 160 can comprise, for example and without limitation, fracturing fluids comprising polylactic acid particulate, beads, or flakes, degradable balls, rope knots, etc.

The diverter remover fluid 180 can be any diverter remover fluid known to those of skill in the art and with the help of this disclosure to be suitable for removal (e.g., disintegration) of the diverter blockage in diverter blocked flow area(s) 165. In embodiments, the diverter removal fluid 180 can comprise, for example, an acid. Although diverter removal fluid, such as an acid, can serve as a diverter remover, in embodiments, diverter removal is effected simply by reservoir temperature and time. In embodiments, non-removable diverter can be utilized and be mechanically removed after the treatment during a wellbore cleanout. In embodiments, in which sealant 151 and diverter 160 are both utilized, if the sealant barrier 150 and the diverter blockage in diverter blocked flow areas 165 are removable by acid, the barrier 150 and diverter blockage can, in embodiments, be removed in a same treatment step via introduction of the acid (e.g., alone or in fracturing fluid).

The sealant 151 comprises any material suitable to provide a temporary fluid flow barrier 150, as described herein. The sealant is thus not particularly limited, so long as it provides a temporary seal, as described herein. In embodiments, the sealant comprises a conformance product or fluid loss control fluid. In embodiments, the sealant comprises a temporary, rigidly crosslinked fluid system. By way of examples, in embodiments, the temporary sealant comprises a cross-linked polymer system, such as TEMBLOK™ conformance product or K-MAX™ fluid loss control fluid. In embodiments, the sealant can thus comprise TEMBLOK 80™ conformance product or K-MAX-PLUS™ fluid loss control fluid. In embodiments, the sealant can be time and/or temperature tailorable for removal/deterioration at a set time/temperature, and/or can also be removed with the sealant remover (e.g., acid). The sealant can be utilized in the heel or near-heel regions of the horizontal portions of the wellbore(s) and/or elsewhere along the length(s) thereof.

The sealant remover fluid 170 can comprise any fluid suitable to remove the sealant barrier 150. In embodiments, the sealant remover comprises an acid, although any suitable sealant remover can be utilized/selected based on the sealant utilized/selected, as will be apparent to one of skill in the art and with the help of this disclosure. The sealant remover 170 can be introduced alone, or as a component of the another fluid being introduced into the wellbore(s) 110 (e.g., the sealant remover can include an acid added to the diverter fluid 160 or the fracturing fluid 155, for example).

Various benefits may be realized by utilization of the presently disclosed methods. The technical improvements in this methodology include, in embodiments, the use of simultaneous fracturing in the application of bullhead refracturing to allow induced stress fields to improve wellbore coverage of the stimulation treatment, as described herein with reference to FIGS. 1-3. Simultaneous fracturing has heretofore not been utilized for bullhead refrac stimulation.

In alternative or additional embodiments, the technical improvements in the herein disclosed methodology can include, positioning/utilizing a temporary, removable sealant barrier to provide resistance to early-treatment stimulation of the heel side of the wellbores. Such sealant chemistry has heretofore not been utilized to provide a temporary, removable seal or barrier to flow, such that early-time heel stimulation may be prevented (e.g., the heel can be bypassed by the fracturing fluid early in the refracturing operation). The sealant material/barrier can be removed throughout the job (e.g., at the end of the refracturing operation), so that the heel portion can be stimulated during the end of the treatment.

In embodiments, the methods of this disclosure can provide enhanced production relative to standard bullhead refracturing operations. In some embodiments, due to the simulfracturing nature of the stimulation, the cost per well associated with each well can be less than the cost per well when a standard, single well bullhead refrac is performed.

Simulfracturing on new drills conventionally requires four wells (not just two), and is done in conjunction with plug and perf, not bullhead fracturing as described herein. Via embodiments of the herein disclosed method, two (or more) previously-fractured wells can be bullhead refractured. Conventional simulfracturing is primarily done for efficiency and pressure reduction purposes. The herein disclosed simultaneous refracturing of previously-fractured wells can be effected to provide lateral coverage improvement.

Sealants, such as described herein (e.g., TEMBLOK™ or other temporary sealants) have not heretofore been utilized for refracturing diversion purposes (i.e., to promote fracturing away from the heel). In embodiments, the temporary sealant barrier can be intentionally removed during the treatment (e.g., at or near the end thereof) to enable stimulation of the blocked zone (i.e., the zone in which the temporary sealant barrier 150 is placed) during the treatment (e.g., at or near the end of the refracturing operations).

Additional Disclosure

The following is provided as additional disclosure for combinations of features and embodiments of the present disclosure.

In a first embodiment, a method (e.g., of refracturing) comprises: (a) introducing a fracturing fluid into each of a plurality of previously-fractured wellbores, wherein the fracturing fluid induces fractures in at least one zone of at least one of the plurality of wellbores, and wherein the fracturing fluid is introduced into each of the plurality of previously-fractured wellbores concurrently/simultaneously for at least a portion of a duration of the introducing; (b) introducing a diverter fluid into each of the plurality of previously-fractured wellbores, wherein the diverter fluid flows into the induced fractures of the at least one zone, reducing flow thereto, and wherein the diverter fluid is introduced into each of the plurality of previously-fractured wellbores concurrently/simultaneously for at least a portion of a duration of the introducing; and (c) repeating (a) and (b) (e.g., until each of the plurality of previously-fractured wellbores has been refractured), wherein the plurality of previously-fractured wellbores are positioned relative to one another such that regions of induced pressure/stress produced by the concurrent introduction of the fracturing fluid promote/enhance/encourage the at least one zone being fractured in (a) to proceed along the length of the wellbores toward the toes thereof by the end of the refracturing (e.g., by the end of the repeating in (c)).

A second embodiment can include the method according to the first embodiment, wherein each of the previously-fractured wellbores is positioned within at least about 60, 90, 120, 150, 180, 210, 240, 270, 300, 450, or 600 meters (about 200, 300, 400, 500, 600, 700, 800, 900, 1000, 1500, or 2000 feet) from another of the previously-fractured wellbores along at least a portion of a length thereof being refractured.

A third embodiment can include the method according to the first or the second embodiment, wherein the at least the portion of the length being refractured comprises a lateral/horizontal portion.

A fourth embodiment can include the method according to any one of the first to third embodiments, wherein the plurality of previously-fractured wellbores consists of two wellbores (i.e., a first wellbore and a second wellbore), three wellbores, four wellbores, or more.

A fifth embodiment can include the method according to any one of the first to fourth embodiments, further comprising: introducing a sealant into at least one wellbore (e.g., one or each of the plurality of previously-fractured wellbores), whereby the sealant forms a barrier to flow (e.g., at least partly seals off flow) to a region proximal a heel of the at least one wellbore.

A sixth embodiment can include the method according to the fifth embodiment, comprising introducing the sealant into each of the plurality of previously-fractured wellbores.

A seventh embodiment can include the method according to the sixth embodiment, comprising introducing the sealant into each of the plurality of previously-fractured wellbores concurrently during at least a portion of a duration of the introducing of the sealant.

An eighth embodiment can include the method according to any one of the fifth to seventh embodiments, wherein the sealant comprises TEMBLOK™ or K-MAX™.

A ninth embodiment can include the method according to any one of the fifth to eighth embodiments, further comprising introducing a sealant remover (e.g., acid) into the at least one wellbore such that the barrier to flow is at least partly removed.

A tenth embodiment can include the method according to the ninth embodiment, further comprising, subsequent removal of the barrier to flow, introducing fracturing fluid into the at least one wellbore whereby flow of the fracturing fluid into the region proximal/adjacent the heel induces fractures therein.

An eleventh embodiment can include the method according to any one of the first to tenth embodiments, wherein the diverter is at least partly removed during repetition of (a) and (b) at (c) (e.g., due to time or a the introducing at (a) and/or (b)), and/or wherein the method further comprises, subsequent (c), introducing a fluid into the plurality of previously-fractured wellbores to at least partly remove (e.g., disintegrate) the diverter.

A twelfth embodiment can include the method according to any one of the first to eleventh embodiments, further comprising, subsequent (c), pumping formation fluid to surface via at least one of the plurality of refractured wellbores.

In a thirteenth embodiment, a method (e.g., of refracturing at least one previously-fractured wellbore (e.g., wherein a previously-fractured wellbore comprises an existing wellbore that has previously had (e.g., multi-stage) hydraulic fracturing applied thereto)) comprises: (a) introducing a sealant into at least one previously-fractured wellbore (e.g., one or each) of a plurality of previously-fractured wellbores, whereby the sealant forms a barrier to flow (e.g., at least partly seals off flow) to a region proximal a heel of the at least one wellbore; (b) introducing a fracturing fluid into the at least one previously-fractured wellbore, wherein the fracturing fluid induces fractures in at least one zone of the at least one wellbore; (c) introducing a diverter fluid into the at least one previously-fractured wellbore, wherein the diverter fluid flows into the induced fractures of the at least one zone, reducing flow thereto; (d) repeating (b) and (c) (e.g., until the at least one previously-fractured wellbore has been refractured); and (e) introducing a sealant remover (e.g., acid) into the at least one wellbore such that the barrier to flow is at least partly removed.

A fourteenth embodiment can include the method according to the thirteenth embodiment, wherein the at least one previously-fractured wellbore comprises at least two previously-fractured wellbores, and wherein: (a) comprises introducing the sealant into each of the at least two previously-fractured wellbores simultaneously during at least a portion of a duration of the introducing of the sealant; (b) comprises introducing the fracturing fluid into each of the at least two previously-fractured wellbores simultaneously during at least a portion of a duration of the introducing of the fracturing fluid; (c) comprises introducing the diverter fluid into the at least two previously-fractured wellbores simultaneously during at least a portion of a duration of the introducing of the diverter fluid; and/or (e) comprises introducing the sealant remover (e.g., acid) into the at least two wellbores simultaneously during at least a portion of a duration of the introducing of the sealant remover.

A fifteenth embodiment can include the method according to the thirteenth or fourteenth embodiment, wherein the sealant comprises TEMBLOK™ or K-MAX™.

A sixteenth embodiment can include the method according to any of the thirteenth to fifteenth embodiments, further comprising, subsequent (e), introducing fracturing fluid into the at least one wellbore, whereby flow of the fracturing fluid into a region proximal/adjacent the heel induces fractures therein.

A seventeenth embodiment can include the method according to any one of the thirteenth to sixteenth embodiments, further comprising, subsequent (e), pumping formation fluid to surface via the at least one (e.g., now refractured) wellbore.

An eighteenth embodiment can include the method according to any one of the thirteenth to seventeenth embodiments, wherein the refracturing comprises bullhead refracturing.

In a nineteenth embodiment, a method (e.g., of refracturing a plurality of previously-fractured wellbores (e.g., wherein a previously-fractured wellbore comprises an existing wellbore that has previously had (e.g., multi-stage) hydraulic fracturing applied thereto)) comprises: (a) introducing a sealant into at least one of a plurality of previously-fractured wellbores, whereby the sealant forms a barrier to flow (e.g., at least partly seals off flow) to a region proximal a heel of the at least one of the plurality of previously-fractured wellbores; (b) introducing a fracturing fluid into each of the plurality of previously-fractured wellbores, wherein the fracturing fluid induces fractures in at least one zone of at least one of the plurality of previously-fractured wellbores; (c) introducing a diverter fluid into the plurality of previously-fractured wellbores, wherein the diverter fluid flows into the induced fractures of the at least one zone, reducing flow thereto; (d) repeating (b) and (c) (e.g., until the plurality of previously-fractured wellbores have been refractured); and (e) introducing a sealant remover (e.g., acid) into the at least one previously-fractured wellbore of (a) such that the barrier to flow is at least partly removed.

A twentieth embodiment can include the method according to the nineteenth embodiment, wherein the diverter is at least partly removed during repetition of (b) and (c) at (d) (e.g., due to time or a the introducing at (b) and/or (c)), and/or wherein the method further comprises, subsequent (d), introducing a fluid into the plurality of previously-fractured wellbores to at least partly remove (e.g., disintegrate) the diverter.

A twenty first embodiment can include the method of the nineteenth or twentieth embodiment, further comprising, subsequent (e), pumping formation fluid to surface via at least one of the plurality of previously-fractured (e.g., now refractured) wellbores that has been refractured.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. When a feature is described as "optional," both embodiments with this feature and embodiments without this feature are disclosed. Similarly, the present disclosure contemplates embodiments where this feature is required and embodiments where this feature is specifically excluded. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure.

What is claimed is:

1. A method comprising:

(a) introducing a fracturing fluid into each of a plurality of previously-fractured wellbores, wherein the fracturing fluid induces fractures in at least one zone of at least one of the plurality of wellbores, and wherein the fracturing fluid is introduced into each of the plurality of previously-fractured wellbores concurrently for at least a portion of a duration of the introducing of the fracturing fluid into each of the previously-fractured wellbores;

(b) introducing a diverter fluid into each of the plurality of previously-fractured wellbores, wherein the diverter fluid flows into the induced fractures of the at least one zone, reducing flow thereto, and wherein the diverter fluid is introduced into each of the plurality of previously-fractured wellbores concurrently for at least a portion of a duration of the introducing of the diverter fluid into each of the plurality of previously-fractured wellbores; and (c) repeating (a) and (b), wherein the plurality of previously-fractured wellbores are positioned relative to one another such that regions of induced pressure produced by the concurrent introduction of the fracturing fluid encourage the at least one zone being fractured in (a) to proceed along the length of the wellbores toward the toes thereof by the end of the refracturing, and further comprising, prior to (a), introducing a sealant into each of the plurality of previously-fractured wellbores, whereby the sealant forms a barrier to flow to a region proximal a heel of each of the previously fractured wellbores, wherein the sealant is introduced into each of the plurality of previously fractured wellbores concurrently for at least a portion of a duration of introducing of the sealant.

2. The method of claim 1, wherein each of the previously-fractured wellbores is positioned within at least 450 meters (1500 feet) from another of the previously-fractured wellbores along at least a portion of a length thereof being refractured.

3. The method of claim 2, wherein the portion of the length being refractured comprises a lateral/horizontal portion.

4. The method of claim 1, wherein the plurality of previously-fractured wellbores consists of two wellbores, three wellbores, or four wellbores.

5. The method of claim 1, wherein the sealant comprises a temporary, rigidly crosslinked fluid system.

6. The method of claim 1, further comprising introducing a sealant remover into the at least one wellbore such that the barrier to flow is at least partly removed.

7. The method of claim 6 further comprising, subsequent to removal of the barrier to flow, introducing fracturing fluid into the at least one wellbore whereby flow of the fracturing fluid into the region proximal/adjacent the heel induces fractures therein.

8. The method of claim 1, wherein the diverter is at least partly removed during repetition of (a) and (b) at (c), and/or wherein the method further comprises, subsequent to (c), introducing a fluid into the plurality of previously-fractured wellbores to at least partly remove the diverter.

9. The method of claim 1 further comprising, subsequent to (c), pumping formation fluid to surface via at least one of the plurality of refractured wellbores.

10. A method of refracturing at least one previously-fractured wellbore, the method comprising:

(a) introducing a sealant into at least one previously-fractured wellbore of a plurality of previously-fractured wellbores, whereby the sealant forms a barrier to flow to a region proximal a heel of the at least one wellbore;

(b) introducing a fracturing fluid into the at least one previously-fractured wellbore, wherein the fracturing fluid induces fractures in at least one zone of the at least one wellbore;

(c) introducing a diverter fluid into the at least one previously-fractured wellbore, wherein the diverter fluid flows into the induced fractures of the at least one zone, reducing flow thereto;

(d) repeating (b) and (c); and (e) introducing a sealant remover into the at least one wellbore such that the barrier to flow is at least partly removed.

11. The method of claim 10, wherein the at least one previously-fractured wellbore comprises at least two previously-fractured wellbores, and wherein:

(a) comprises introducing the sealant into each of the at least two previously-fractured wellbores simultaneously during at least a portion of a duration of the introducing of the sealant;

(b) comprises introducing the fracturing fluid into each of the at least two previously-fractured wellbores simultaneously during at least a portion of a duration of the introducing of the fracturing fluid;

(c) comprises introducing the diverter fluid into the at least two previously-fractured wellbores simultaneously during at least a portion of a duration of the introducing of the diverter fluid; and/or (e) comprises introducing the sealant remover into the at least two wellbores simultaneously during at least a portion of a duration of the introducing of the sealant remover.

12. The method of claim 10 further comprising, subsequent to (e), introducing fracturing fluid into the at least one wellbore, whereby flow of the fracturing fluid into a region proximal/adjacent the heel induces fractures therein.

13. The method of claim 10 further comprising, subsequent to (e), pumping formation fluid to surface via the at least one wellbore.

14. The method of claim 10, wherein the refracturing comprises bullhead refracturing.

15. The method of claim 10, wherein each of the previously-fractured wellbores is positioned within at least 450 meters (1500 feet) from another of the previously-fractured wellbores along at least a portion of a length thereof being refractured.

16. The method of claim 15, wherein the portion of the length being refractured comprises a lateral/horizontal portion.

17. A method comprising:

(a) introducing a sealant into at least one of a plurality of previously-fractured wellbores, whereby the sealant forms a barrier to flow to a region proximal a heel of the at least one of the plurality of previously-fractured wellbores;

(b) introducing a fracturing fluid into each of the plurality of previously-fractured wellbores, wherein the fracturing fluid induces fractures in at least one zone of at least one of the plurality of previously-fractured wellbores;

(c) introducing a diverter fluid into the plurality of previously-fractured wellbores, wherein the diverter fluid flows into the induced fractures of the at least one zone, reducing flow thereto;

(d) repeating (b) and (c); and (e) introducing a sealant remover into the at least one previously-fractured wellbore of (a) such that the barrier to flow is at least partly removed.

18. The method of claim 17, wherein the diverter is at least partly removed during repetition of (b) and (c) at (d), and/or wherein the method further comprises, subsequent to (d), introducing a fluid into the plurality of previously-fractured wellbores to at least partly remove the diverter.

19. The method of claim 17 further comprising, subsequent to (e), pumping formation fluid to surface via at least one of the plurality of previously-fractured wellbores that has been refractured.

20. The method of claim 17, wherein each of the previously-fractured wellbores is positioned within at least 450 meters (1500 feet) from another of the previously-fractured wellbores along at least a portion of a length thereof being refractured and wherein the portion of the length being refractured comprises a lateral/horizontal portion.

* * * * *